US006179754B1

(12) United States Patent
Wang et al.

(10) Patent No.: US 6,179,754 B1
(45) Date of Patent: Jan. 30, 2001

(54) SPORTS TREADMILL

(76) Inventors: Leao Wang; Peter Wu, both of No 1, Lane 233, Sec. 2, Charng Long Rd., Taiping (TW), 411

( * ) Notice: Under 35 U.S.C. 154(b), the term of this patent shall be extended for 0 days.

(21) Appl. No.: 09/467,224

(22) Filed: Dec. 20, 1999

Related U.S. Application Data

(63) Continuation-in-part of application No. 09/247,571, filed on Feb. 10, 1999.

(51) Int. Cl.[7] ..... A63B 22/02
(52) U.S. Cl. ..... 482/54; 482/21
(58) Field of Search ..... 482/51, 54

(56) References Cited

U.S. PATENT DOCUMENTS 5,100,127 * 3/1992 Melnick et al. ..... 482/54
5,318,491 * 6/1994 Houston ..... 482/54
5,562,572 * 10/1996 Carmein ..... 482/54
5,752,897 * 5/1998 Skowronski et al. ..... 482/54
5,800,314 * 9/1998 Sakakibara et al. ..... 482/54
5,919,119 * 7/1999 Bohmer et al. ..... 482/54

* cited by examiner

*Primary Examiner*—Glenn E. Richman
(74) *Attorney, Agent, or Firm*—Dougherty & Troxell

(57) ABSTRACT

The present invention relates to a sports treadmill comprising a plurality of detectors disposed at two sides of the main body of the sports treadmill adjacent to the running belt, and the detectors have a sending terminal and a receiving terminal so that, when the positions of the front and the rear feet of the runner is detected by the detectors, the detected value is rapidly transmitted to a central processing unit of a microcomputer inside of the electronic control panel while the exact position of the runner on the running belt is analyzed by the central processing unit; thereafter, a command to accelerate or decelerate will be given by the central processing unit to the motor in order to create an immediate control effect of the rotation speed of the running belt to achieve an automatic adjusting effect of the present invention in accordance with the running speed of the runner.

3 Claims, 2 Drawing Sheets

SPORTS TREADMILL

The present invention is a continuation-in-part of U.S. patent application Ser. No. 09/247,571, field Feb. 10, 1999.

BACKGROUND OF THE INVENTION

The present invention relates to a sports treadmill, and more particularly, to a device with human effect in which the rotation speed of the motor can be automatically and synchronously changed in accordance with the running speed of the runner. Thc previous invention is provided with an automatic rolling band tied on the human body with the position of the band sensed by a sensor, thereafter, the detected value will be transmitted to a central processing unit (CPU) to obtain the exact information of the runner's position on the running belt in order to give an acceleration or a deceleration command and to achieve the expected effect. However, the runner will feel impractical and uncomfortable because he has to be tied by said band so that the use desire will be diminished and the effect of the installation of said band is lost.

Before describing the features of the present invention, a number of phenomena in jogging on the sports treadmill are briefly concluded as follows in order to understand the basic control principles of the present invention:

1. The position of the runner is kept unchanged when the running speed of the runner and the rotation speed of the running belt are the same.
2. The runner is shifted to the front side of the sports treadmill when the running speed of the runner is higher than the rotation speed of the running belt.
3. The runner is shifted to the rear side of the sports treadmill when the running speed of the runner is lower than the rotation speed of the running belt.

Therefore, the position of the runner will be changed in accordance with his running speed when he stands at the center of the sports treadmill to do jogging.

SUMMARY OF THE INVENTION

In order to remove the above-mentioned disadvantages, it is a main object of the present invention to provide a sports treadmill, wherein an automatic detector with infrared rays replaces said band and said sensor in order to obtain an exact information of the runner's position on the running belt.

BRIEF DESCRIPTION OF THE DRAWINGS

The drawings illustrate an embodiment of the present invention which serves to exemplify the various advantages and objects hereof, and are as follows.

DETAILED DESCRIPTION OF THE PREFERRED EMBODIMENT

Figure 1:
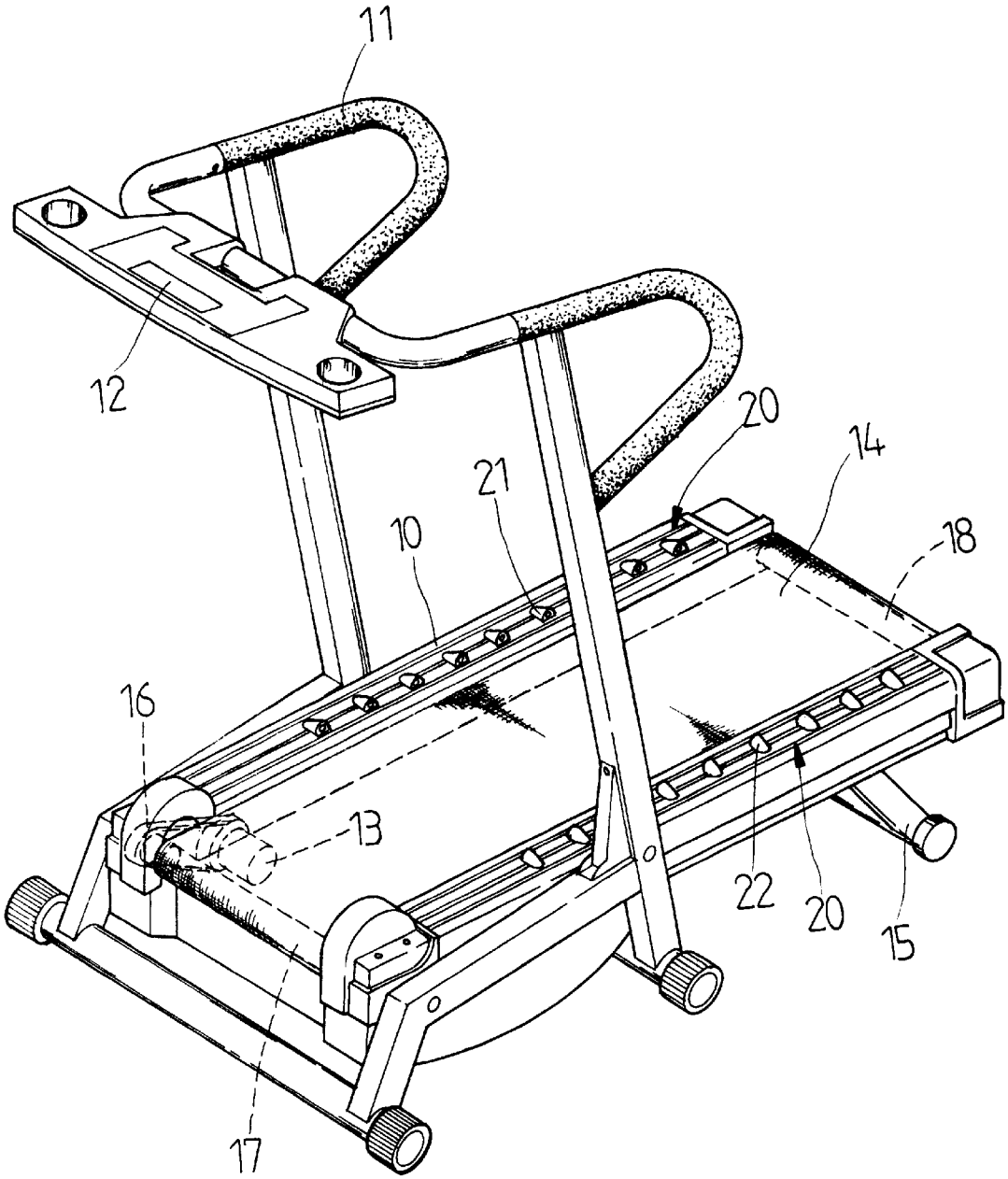
FIG. 1 is a preferred embodiment of the present invention.

First of all, referring to FIG. 1, it shows a preferred embodiment of the present invention. From the drawing, it's apparent that the sports treadmill in accordance with the present invention includes a main body 10 of the frame of the sports treadmill, a hand support 11, an electronic control panel 12, a motor 13, a running belt 14 and a rear supporting rod 15, wherein the motor 13 can drive a belt 16 which drives a front rolling wheel 17, and the running belt 14 is disposed on a front and a rear rollers 17, 18 which are rotated by means of the transmission of the motor 13. The present invention is characterized in that a plurality of detectors 20 are disposed at two sides of the main body 10 of the sports treadmill adjacent to the running belt 14, and the detectors 20 have a sending terminal 21 and a receiving terminal 22 so that, when the positions of the front and the rear feet of the runner are detected by the detectors 20, the detected value is rapidly transmitted to a central processing unit of a microcomputer inside of the electronic control panel 12 while the exact position of the runner on the running belt 14 is analyzed by the central processing unit. Thereafter, a command to accelerate or decelerate will be given by the central processing unit to the motor 13 in order to create an immediate control effect of the rotation speed of the running belt 14 to achieve an automatic adjusting effect of the present invention in accordance with the running speed of the runner.

The reason why the detectors 20 detect the position of the front and the rear feet of the runner lies in that the body ol the runner is located between the front and the rear feet so that the measured data of the position of the front and the rear feet of the runner is divided by two to get the information of the current position of runner.

Figure 2:
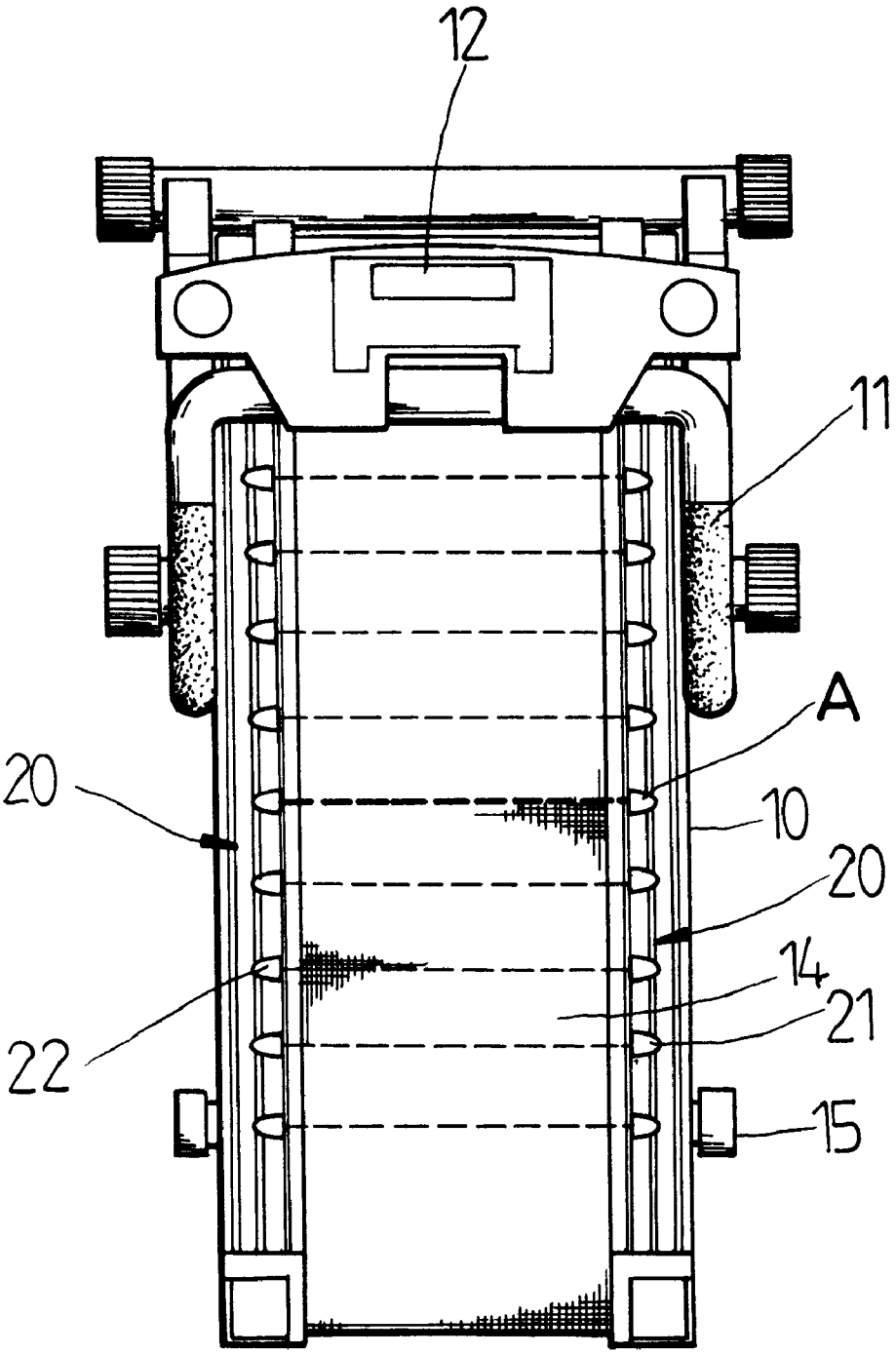
FIG. 2 is a schematic drawing of the positions of detectors of the present invention.

The operation of the detectors 20, as shown in FIG. 2, lies in that each sending terminal 21 of the detectors 20 emits one straight light beam (shown by the dotted line in FIG. 2) to the corresponding receiving terminal 22. Point A at the center of the main body 10 is considered as a basic point which means that the runner is situated at the center of the main body 10 so that the CPU gives an acceleration command to the motor 13 when the detected value shows that the runner is located in front of the point A while the CPU gives an deceleration command to the motor 13 when the detected value shows that the runner is located behind the point A. Accordingly, when the running speed of the runner is higher than the speed of the running belt 14, the body of the runner will gradually shift to the front side of the main body 10 so that the runner's body is situated at the front of the point A of the main body 10. At that time, the detectors 20 detect the position change of the runner. Thus, the CPU will give an acceleration command to the motor 13 immediately by means of presetting the CPU. And vice versa., when the running speed of the runner is lower than the speed of the running belt 14, the body of the runner will gradually shift to the rear side of the main body 10 so that the runner's body is situated at the rear of the point A of the main body 10. At that time, the detectors 20 detect the position change of the runner. Again, the CPU will give a deceleration command to the motor 13 immediately by means of presetting the CPU.

When the detected value by the detectors 20 shows that the runner is still situated in front of the point A, the motor 13 will continuously accelerate, and this continuous acceleration is aimed that the rotation speed of the running belt 14 can be a little higher than the running speed of the runner in order that the position of the runner returns to the center of the main body 10 (that is point A), and the acceleration won't stop until the position of the runner returns to the center of the main body 10. At that time, the rotation speed is identical to the speed of the running speed of the runner. In other words, the rotation speed of the running belt 14 is higher than that before acceleration in order to adapt to the accelerated running speed of the runner. Likewise, When the detected value by the detectors 20 shows that the runner is still situated behind the point A, the motor 13 will continuously decelerate until the position of the runner gradually returns to the center of the main body 10 so that the rotation speed can be adapted to the decelerated running speed of the runner.

In order to make the acceleration and deceleration of the motor 13 correspond to the speed change of the runner, the acceleration and deceleration of the motor 13 will be greater when the difference between the detected value and the point A is larger, and more gentle vice versa. For example, if the running speed of the runner increases from 5 km/hr. to 10 km/hr., the difference between the detected value by the detectors 20 and the central value of point A is greater so that the acceleration efficiency of the motor 13 will be increased, and if the running speed of the runner increases from 5 km/hr. to 6 km/hr., the difference between the detected value by the detectors 20 and the central value of point A is smaller so that the acceleration efficiency of the motor 13 will be more gentle.

Finally, the present invention can be provided with a position display (not shown) at a suitable position of the main body 10 or at a position visible by the runner in order for him to realize at any time at which position of the main body 10 he is located and to make acceleration or deceleration.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A speed control system for a sports treadmill having a main body with a running belt movably mounted thereon, and a hand support extending from the main body with an electronic control panel mounted thereon, the electronic control panel including a central processing unit (CPU), the speed control system comprising:

a) a motor drivingly connected to the running belt such that a speed of the motor is proportional to a speed of the running belt, the motor speed being controlled by the CPU; and b) a plurality of spaced apart position detectors located on the main body, each position detector comprising a sending terminal located adjacent to a first lateral side of the running belt and a receiving terminal located adjacent to a second lateral side of the running belt, the transmitting terminal emitting a light beam across the running belt and received by the associated receiving terminal, the position detectors transmitting a signal to the CPU when the light beam is interrupted by a runner on the belt, such signal being indicative of an actual position of the runner on the belt, whereby the CPU increases the speed of the motor and the belt if the runner's actual position is forward of a predetermined position and decreases the speed of the motor and the belt if the runner's actual position is rearward of the predetermined position.

2. The speed control system for a sports treadmill of claim 1 wherein the plurality of position detectors are located so as to detect the front and rear positions of the runner's feet.

3. The speed control system for a sports treadmill of claim 1 wherein the increase or decrease in the speed of the motor continues until the runner has returned to the predetermined position.

* * * * *